US006450376B1

(12) United States Patent
Richard

(10) Patent No.: US 6,450,376 B1
(45) Date of Patent: Sep. 17, 2002

(54) REFRACTORY ASSEMBLIES

(75) Inventor: Francois-Noël Richard, Nancy (FR)

(73) Assignee: Vesuvius Crucible Company, Wilmington, DE (US)

( * ) Notice: Subject to any disclaimer, the term of this patent is extended or adjusted under 35 U.S.C. 154(b) by 0 days.

(21) Appl. No.: 09/269,923

(22) PCT Filed: Oct. 15, 1997

(86) PCT No.: PCT/IB97/01280

§ 371 (c)(1),
(2), (4) Date: Jun. 7, 1999

(87) PCT Pub. No.: WO98/17420

PCT Pub. Date: Apr. 30, 1998

(30) Foreign Application Priority Data

Oct. 17, 1996 (FR) ..... 96 12664
Dec. 20, 1996 (FR) ..... 96 15928

(51) Int. Cl.[7] ..... B22D 41/08
(52) U.S. Cl. ..... 222/600; 222/603
(58) Field of Search ..... 222/590, 591, 222/594, 597, 600, 603

(56) References Cited

U.S. PATENT DOCUMENTS

| | | | | |
|---|---|---|---|---|
| 3,887,117 A | | 6/1975 | Fehling | |
| 4,365,731 A | | 12/1982 | Fehling et al. | |
| 4,480,770 A | | 11/1984 | Goursat et al. | |
| 4,555,050 A | | 11/1985 | Shiefer et al. | |
| 4,576,317 A | | 3/1986 | Wenger | |
| 4,660,808 A | | 4/1987 | Daussan et al. | |
| 4,721,236 A | | 1/1988 | Muschner | |
| 4,949,885 A | * | 8/1990 | Struble et al. | 222/590 |
| 5,100,034 A | * | 3/1992 | Russo | 222/600 |
| 5,390,902 A | | 2/1995 | Szadkowski | |
| 5,670,075 A | * | 9/1997 | Vassilicos | 222/603 |
| 5,958,279 A | * | 9/1999 | Kawamura et al. | 222/600 |

FOREIGN PATENT DOCUMENTS

| | | |
|---|---|---|
| EP | 0 171 589 A1 | 2/1986 |
| FR | 2529493 | 1/1984 |
| JP | 01 309769 A | 12/1989 |

* cited by examiner

*Primary Examiner*—Scott Kastler
(74) *Attorney, Agent, or Firm*—James R. Williams

(57) ABSTRACT

The invention relates to a set of refractory assemblies, which is capable of being used between an upstream container and a downstream container of a plant for transferring liquid metal, in particular steel, comprising: a tapping spout via which the metal flows from the upstream container into the downstream container, each refracotry assembly of the tapping spout having at least one surface forming a mating surface with a corresponding surface of an adjacent refractory assembly; a flow regulator for regulating the flow of liquid metal through the tapping spout; a shroud channel placed around the tapping spout near at least one mating surface between refractory assemblies and having an inlet capable of allowing the intake of a fluid; in which the shroud channel has an outlet capable of allowing the fluid to escape to the outside of the plant.

17 Claims, 8 Drawing Sheets

REFRACTORY ASSEMBLIES

FIELD OF THE INVENTION

The present invention relates to a set of refractory assemblies and a method for transferring liquid metal from a first container to a second container or mold, wherein the refractories have a channel for injection of inert gas.

BACKGROUND OF THE INVENTION

The present invention relates to a refractory assembly or a set of refractory assemblies for a plant for transferring liquid metal from an upstream container to a downstream container, comprising: an upstream container; a downstream container; a taphole in the upstream container; a flow regulator for regulating the flow of liquid metal through the taphole; a set of refractory assemblies which are placed between the upstream container and the downstream container in the extension of the taphole and delimit a tapping spout via which the metal flows from the upstream container into the downstream container, each refractory assembly of the tapping spout having at least one mating surface forming a joint with a corresponding surface of an adjacent refractory assembly; a shroud channel placed around the tapping spout near at least one mating surface between refractory assemblies.

Refractory assembly is understood to mean a monolithic component consisting of one or more amounts of refractory, possibly comprising other constituents, for example a metal shell. Flow regulator is understood to mean any type of device used in this technical field, such as a stopper rod, a slide gate valve, and also a simple restriction.

In a plant of this type, the presence of a regulator in the tapping spout means that, when the liquid metal is flowing, there is a pressure drop. If the tapping spout is not perfectly sealed, air can be drawn into it because of this reduced pressure. This is generally the case, in particular at the mating surfaces between the various refractory assemblies, which form the tapping spout, the sealing of which is difficult to achieve and to maintain. Air is therefore drawn in, which results in a degradation in the quality of the metal.

In order to solve this problem, it is known to create, by means of a shroud channel, an overpressure of an inert gas around the tapping spout, near each critical mating surface. Inert gas is understood to mean here a gas, which does not impair the quality of the tapped metal. Among the gases normally used may be found nobel gases, such as argon, but also gases such as nitrogen or carbon dioxide.

According to a known embodiment, a groove is formed in at least one of the mating surfaces between two adjacent refractory assemblies. This groove is fed with pressurized inert gas and thus forms an annular shroud channel placed around the tapping spout. Such an embodiment is known, for example, from U.S. 4,555,050 or EP 0, 048, 641.

In the particular case in which successive refractory assemblies are able to move with respect to each other, the use of a shroud channel is also known. French Patent Application FR 74/14636 describes a slide gate valve having two plates, each plate having a hole through which the liquid metal passes, the sliding of one plate with respect to the other enabling the flow of liquid metal to be regulated. These two plates each have, along their common mating plane, a U-shaped groove placed head to tail with respect to each other so that the arms of one of the U's overlap the arms of the other U, and thus produce a closed shroud channel whatever the relative position of the two plates.

All these known arrangements are used to replace the induction of air by the induction of an inert gas, thereby eliminating the chemical problem associated with the liquid metal coming into contact with air.

However, these known solutions have several disadvantages.

The introduction of gas into the tapping spout is not eliminated. It is even increased because the shroud channel is at an overpressure. This is a drawback particularly in the case of transfer of metal between a tundish and a continuous-casting mold. The gas introduced into the tapping spout ends up in the mold and causes perturbations therein, such as turbulence, movement of the coverage powder and the trapping of this powder in the liquid metal. The gas entrained into the mold may furthermore become dissolved in the liquid metal and subsequently create defects in the solidified metal. These perturbations therefore degrade the quality of the metal produced.

In addition, in order to reduce the speed of the metal as it enters the mold, and thus to reduce the turbulence in this mold, many types of jet shroud tubes have an outlet cross-section greater than their inlet cross-section. The speed of flow of the liquid metal then decreases gradually. The presence of a significant quantity of gas in the tube may prevent correct operation of this type of tube: the flow may separate from the walls of the tube and the liquid metal then drops as a jet into the mold.

The quality of a mating surface between two refractory assemblies may vary while the tapping spout is being used. Defects may appear and, in particular in the case of refractory assemblies which can move with respect to each other, wear of the mating surface may lead to significant leakage.

It is therefore necessary to make the regulation of the supply of inert gas into the shroud channel more sophisticated.

One possibility is to regulate the flow of inert gas introduced into the shroud channel. In this case, if the sealing defect becomes significant, it may happen that the flow rate of inert gas is no longer high enough f or only the inert gas to enter the tapping spout. In this case, the pressure in the shroud channel becomes negative and ambient air can be drawn into the tapping spout. On the other hand, if the sealing is good, a fixed flow of inert gas is nevertheless introduced into the shroud channel, the pressure therein increases and the inert gas enters the tapping spout without this really being necessary.

Another possibility is to regulate the pressure of the inert gas as it is being introduced into the shroud channel. In this case, if the sealing defect becomes significant, the flow rate of inert gas entering the tapping spout is high, which leads to the defects mentioned above.

In practice, when the leakage rate is high it is necessary to use these two modes of regulation in alter nation, even if this means accepting a certain amount of air being drawn in rather than too great an excess of inert gas. Consequently, management of the regulation is complex and necessarily includes compromises between two types of disadvantages.

SUMMARY OF THE INVENTION

The subject of the present invention is specifically a plant for transferring liquid metal, which solves the problems explained above, and sets of refractory assemblies enabling it to be operated.

The subject of the invention is also a method of regulating the supply of inert gas into a shroud channel.

The subject of the invention is furthermore a method making it possible to improve the sealing of the mating surfaces between refractory assemblies during use of the tapping spout.

The invention relates to a set of refractory assemblies, comprising at least two refractory assemblies, which is capable of being used between an upstream container and a downstream container of a plant for transferring liquid metal, in particular steel. Such a plant generally comprises a tapping spout via which the metal flows from the upstream container into the downstream container, each refractory assembly of the tapping spout having at least one surface forming a mating surface with a corresponding surface of an adjacent refractory assembly; a flow regulator for regulating the flow of liquid metal through the tapping spout; a shroud channel placed around the tapping spout near at least one mating surface between refractory assemblies and having an inlet capable of allowing the intake of a fluid.

The said at least two refractory assemblies comprise means capable of forming the said shroud channel.

The invention is characterized in that the said shroud channel has an outlet capable of allowing a fluid to escape to the outside of the plant. In a preferred variant of the invention, the shroud channel has an inlet at one end and an outlet at the other end. Preferably, it is linear and continuous. The inlet of the shroud channel and its outlet may be provided on a single refractory assembly. The entirety of the shroud channel is then made in this refractory assembly. The shroud channel may also run through several mating surfaces of the tapping spout in succession, the continuity of the shroud channel being provided by corresponding communications of the said channel at the mating surfaces. In particular, the set of refractory assemblies may comprise two refractory assemblies, the inlet of the shroud channel being located on one of these assemblies and the outlet of the shroud channel being located on the other.

In a preferred variant of the invention, a calibrated head loss, terminated by a venting outlet, is connected to the outlet of the shroud channel. This calibrated head loss may be connected to the outlet of the shroud channel outside the set of refractory assemblies, but may also consist of a duct of small cross-section and of suitable length made within the actual refractory assembly.

The sets of refractory assemblies according to the invention may comprise plates constituting a movable slide gate valve. In this case, at least one of the plates has a first U-shaped part of the shroud channel, the arms of which U are aligned with the movement of the slide gate valve. A second plate, adjacent to the previous one, has a second U-shaped part of the shroud channel, opposite the previous one. One arm of the U of one of the plates is partially superposed an one arm of the U of the other plate for at least certain positions of the slide gate valve so as to ensure continuity of the shroud channel. The arms of the shroud channel, which are opposite the superposed arms, are offset so that there is no superposition between them, whatever the position of the slide gate valve. The parts of the shroud channel are capable of being connected together and to the adjacent refractory assemblies so as to form a continuous linear shroud channel. In the case of the plates of such a slide gate valve, the U-shaped part of the shroud channel may be placed non-symmetrically with respect to the tapping spout.

The invention also relates to a refractory assembly which can be used in a set of refractory assemblies, as described previously.

The invention furthermore relates to a plant for transferring liquid metal, in particular steel, between an upstream container and a downstream container, characterized in that it comprises a set of refractory assemblies, as described previously.

In a preferred variant, this plant comprises means capable of introducing a sealing agent into the shroud channel. The sealing agent may be a powder, and in particular a powder having particles of varying size. Included among powders which are useful as the sealing agent are graphite or other refractories, and enamels which are fusible at the temperature of the shroud channel and the viscosity of which, in the liquid state, is sufficient to close off, at least partially, the leaks in the shroud channel. The sealing agent may also be chosen from paints and resins. It may also be chosen from salts or metals.

Finally, the invention relates to a method of regulating the supply of inert gas in a plant for transferring liquid metal according to the invention. Within the scope of this method, a flow of inert gas is introduced into the shroud channel, the flow being set at a high enough value for an excess of inert gas to escape via the outlet whatever the flow rate of inert gas drawn into the tapping spout. In a preferred variant of this method, the following steps are carried out:

- a flow of inert gas is injected into the shroud channel;
- the pressure of the inert gas at its inlet into the shroud channel is measured;
- the flow rate of inert gas injected into the shroud channel is regulated to a set value;
- the flow rate of inert gas at the venting outlet is calculated;
- the set value of the flow rate of inert gas injected into the shroud channel is adjusted in such a way that the flowrate of inert gas at the venting outlet is always positive.

In an improvement of this method, the flow rate of inert gas drawn into the tapping spout is determined by the difference between the flow rate of inert gas injected into the shroud channel and the flow rate of inert gas at the venting outlet, and a sealing agent is then injected into the shroud channel when the said flow rate of inert gas drawn into the tapping spout exceeds a permitted limit.

Because of the linear and continuous arrangement of the shroud channel, the circulation of the inert gas ensures that the sealing agent is transported over the entire length of this channel, thereby avoiding dead zones. The presence of the opening of the shroud channel enables any excess sealing agent to be removed to the outside of the plant.

Other features of the invention will appear on reading the description which follows, reference being made to the appended figures. In these figures:

BRIEF DESCRIPTION OF THE INVENTION

DETAILED DESCRIPTION OF THE INVENTION

Figure 1:
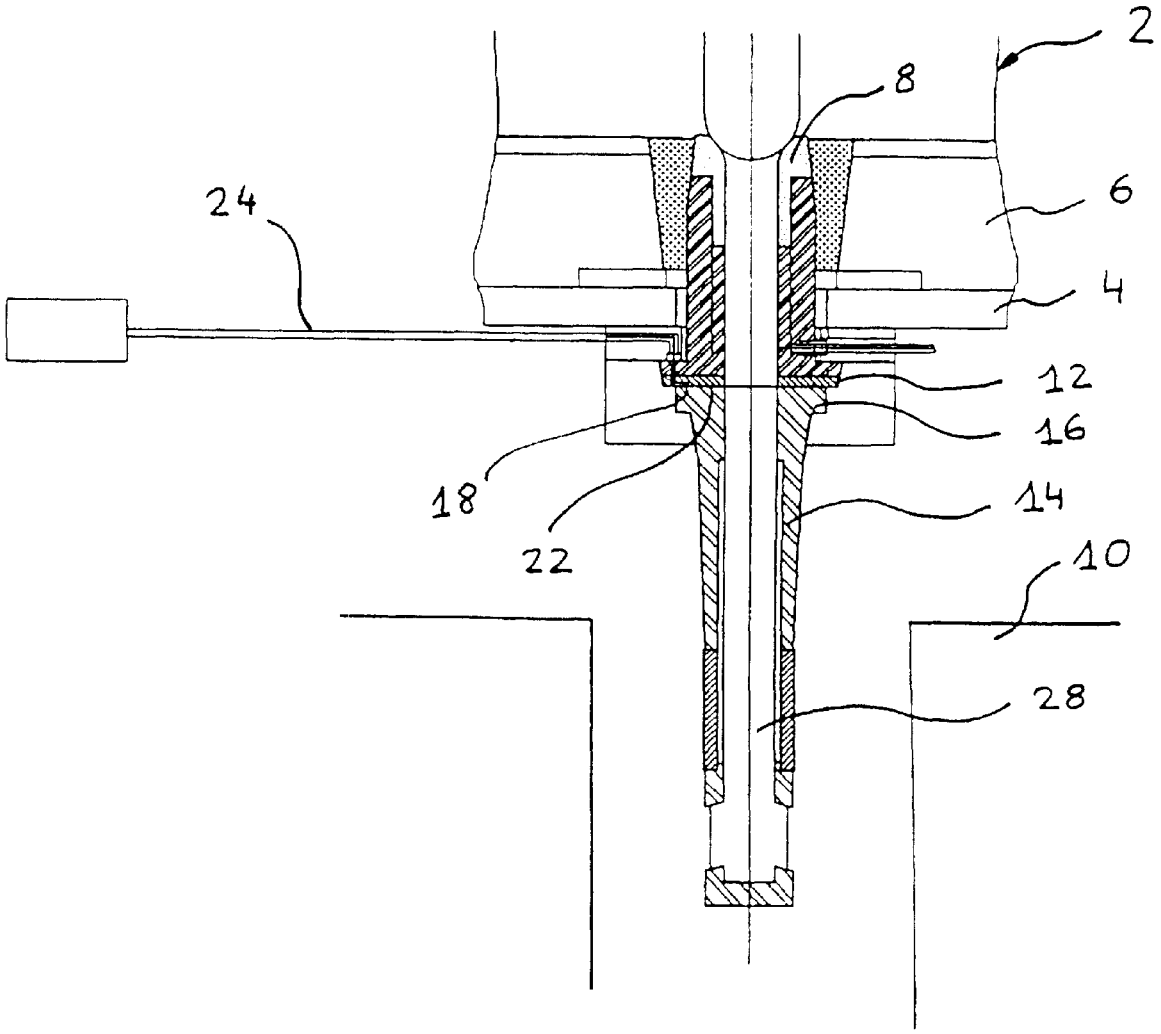
FIG. 1 is an overall view, in vertical cross-section, of a plant for transferring liquid metal according to the prior art.

FIG. 1 shows a plant for transferring liquid metal according to the prior art. It comprises an upstream container 2. In the example shown, the upstream container 2 is a tundish which has a steel bottom wall 4 covered with a layer of refractory 6. A taphole is provided in the bottom of the tundish. This taphole is delimited by an internal nozzle 8 which is mounted in the thickness of the refractory and passes through the steel bottom wall 4. The plant also comprises a downstream container 10. In the example shown, the downstream container 10 consists of a continuous-casting mold.

The internal nozzle 8 terminates at its lower part in a plate 12. Under the internal nozzle 8 is a jet shroud tube 14 terminated at its upper part in a plate 16 which matches the plate 12 of the internal nozzle 8. In a known manner, the plates 12 and 16 are pressed against each other by known means so as to seal them as completely as possible. A closed shroud channel 13 consists of an annular groove 20 made in the mating surface 22 between the plate 12 and the plate 16. A pipe 24 for supplying an inert gas is connected to this annular groove 20. Denoted by the reference 26 are means for regulating the flow of metal, in this case a stopper rod. The internal nozzle 8 and the jet shroud tube 14 delimit a tapping spout 28 via which the metal flows from the upstream container 2 into the downstream container. In the embodiment example shown, the plant has only two refractory assemblies (the internal nozzle 8 and the jet shroud tube 14), but it could have more of them, for example in the case of a plant equipped with a slide gate valve having three plates. Each refractory component delimiting the tapping spout 28 has at least one surface forming a mating surface 22 with a corresponding surface of an adjacent refractory component.

Figure 2:
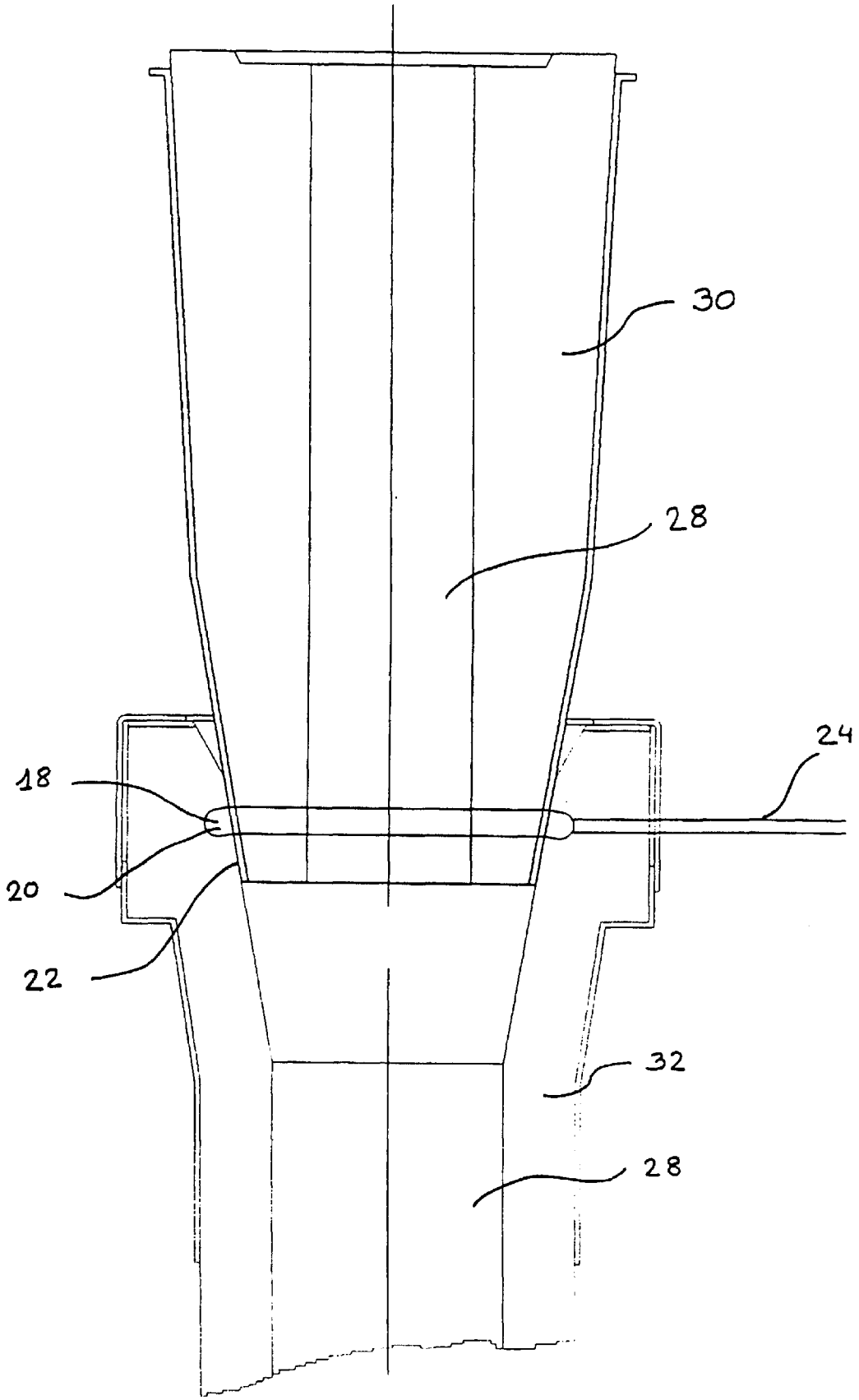
FIG. 2 is a detailed view, in vertical crosssection, of a plant for transferring liquid metal according to the prior art.

FIG. 2 is a detailed view of another example showing part of a plant for transferring liquid metal according to the prior art. The figure shows a collecting nozzle 30 inserted into a jet shroud tube 32, which thus form a tapping spout 28. The junction between the two refractory assemblies has a mating surface 22. A closed shroud channel 18 consists of an annular groove 20 made in the mating surface 22 of the jet shroud tube 32. A pipe 24 for supplying the inert gas is connected to this annular groove 20.

Both in the embodiment shown in FIG. 1 and that shown in FIG. 2, the shroud channel 18 is a closed annular channel having an inert-gas feed, which involves a complex management of the regulation of the supply of inert gas.

Figure 3:
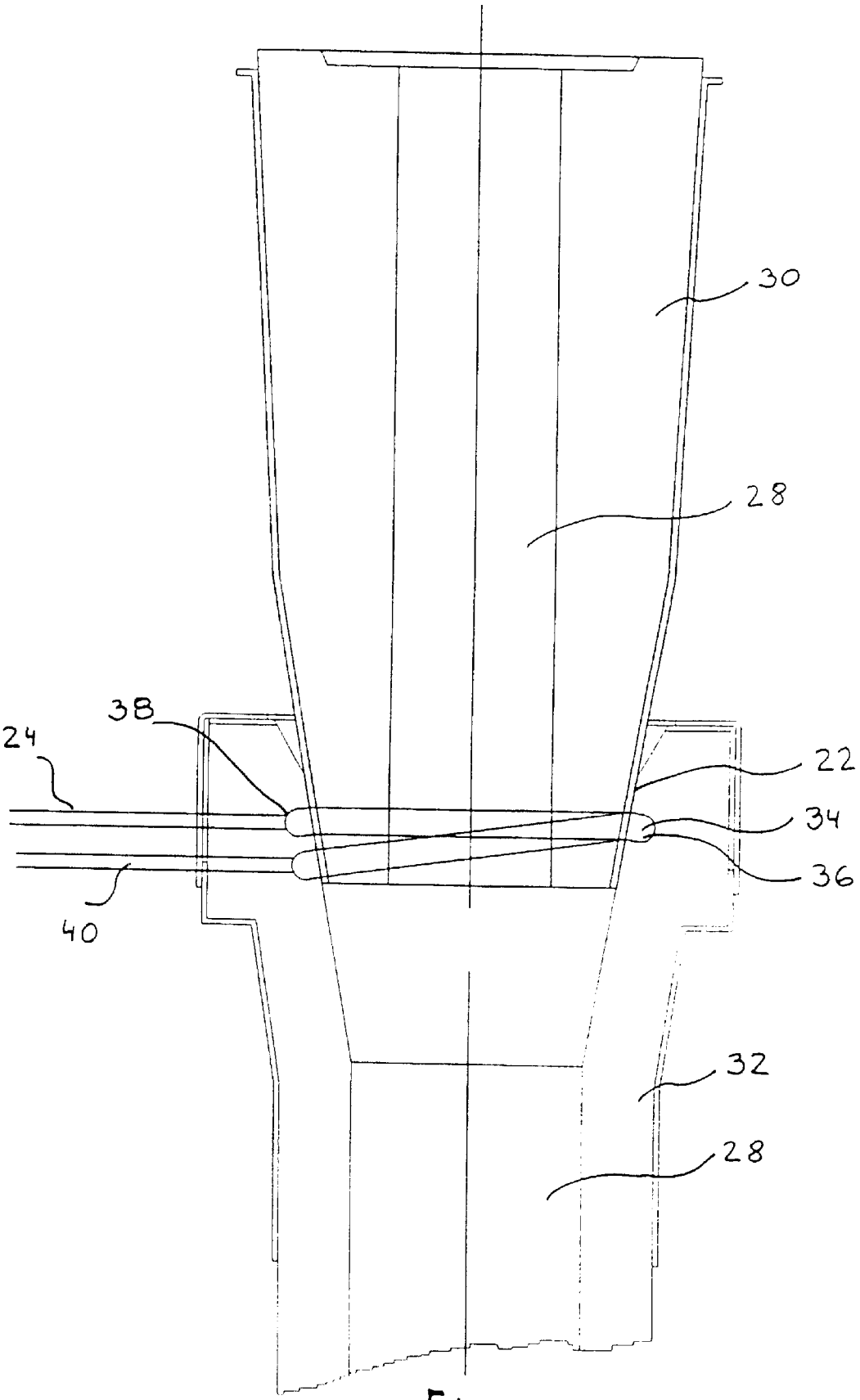
FIG. 3 is a detailed view, in vertical cross-section, of such a plant according to the invention, in which a linear shroud channel consists of a groove having an inlet and an outlet.

FIG. 3 shows a plant for transferring liquid metal according to one embodiment of the invention. In the latter, the shroud channel 34 consists of a groove 36 which is not annular but linear, and has an inlet 38 at one end connected to the pipe 24 for supplying the inert gas and an outlet 40 at the other end, enabling the inert gas to escape to the outside of the plant. In the example shown in FIG. 3, the shroud channel has a helical shape. This embodiment is particularly suited to conical mating surfaces. In the example shown, the groove 36, the inlet 38 and the outlet 40 are made in a single refractory assembly 32, but these three components could be made on the other refractory assembly 30, in totality or in part, without departing from the scope of the invention.

Figure 4:
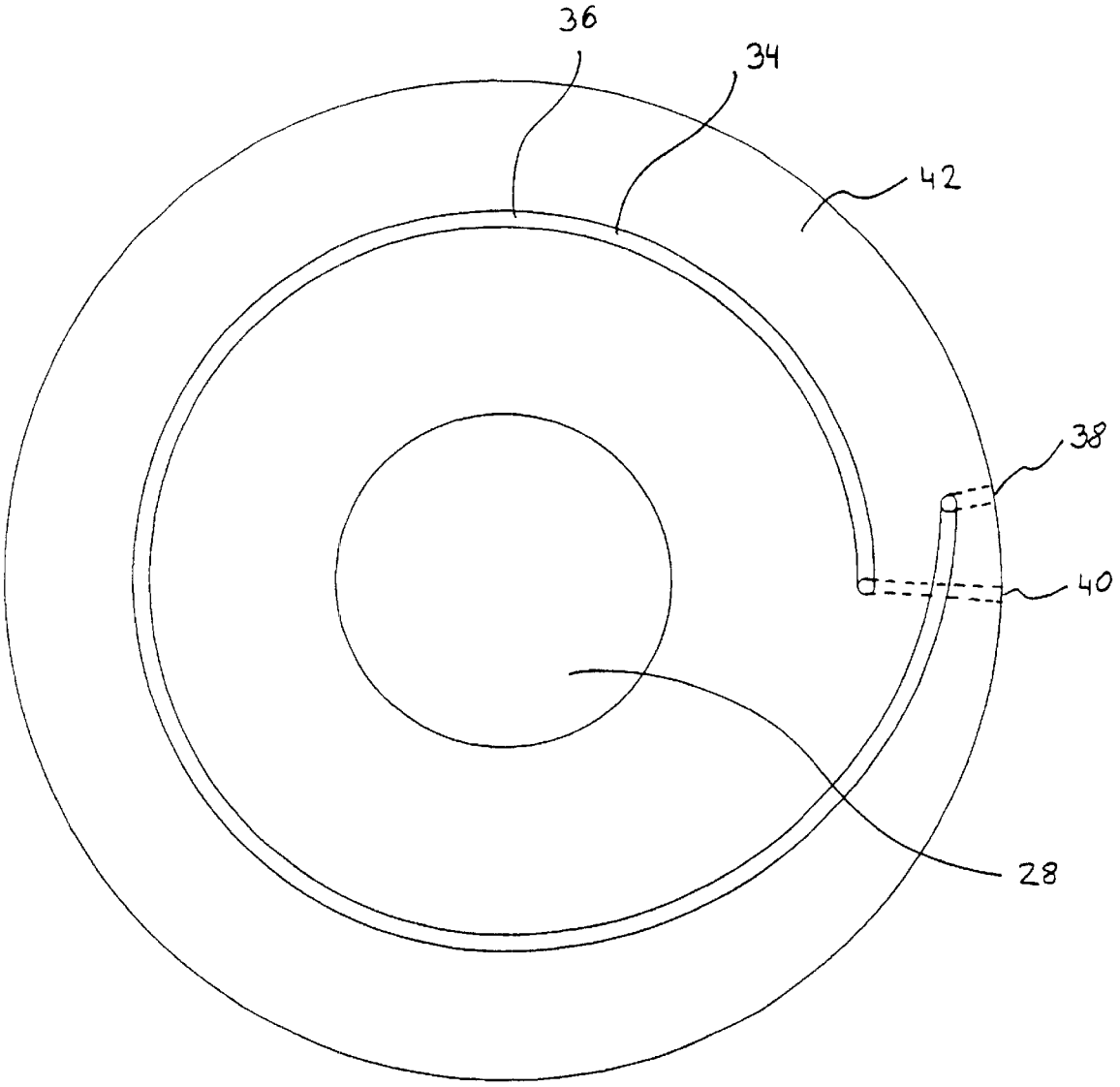
FIG. 4 is a view from above of a detail of a plant according to the invention, in which the linear shroud channel consists of a groove having an inlet and an outlet.

FIG. 4 is a view from above of a refractory assembly 42 according to the invention. The inlet 38 and the outlet 40 of the shroud channel 34 consisting of a linear groove 36 emerge on the periphery of the refractory assembly via holes drilled in the mass of the refractory. This view of the refractory assembly 42 could, for example, be a lower face of an internal nozzle, an upper face of a jet shroud tube, a plate of a tube changer or, more generally, any section of a tapping spout 28.

Figure 5:
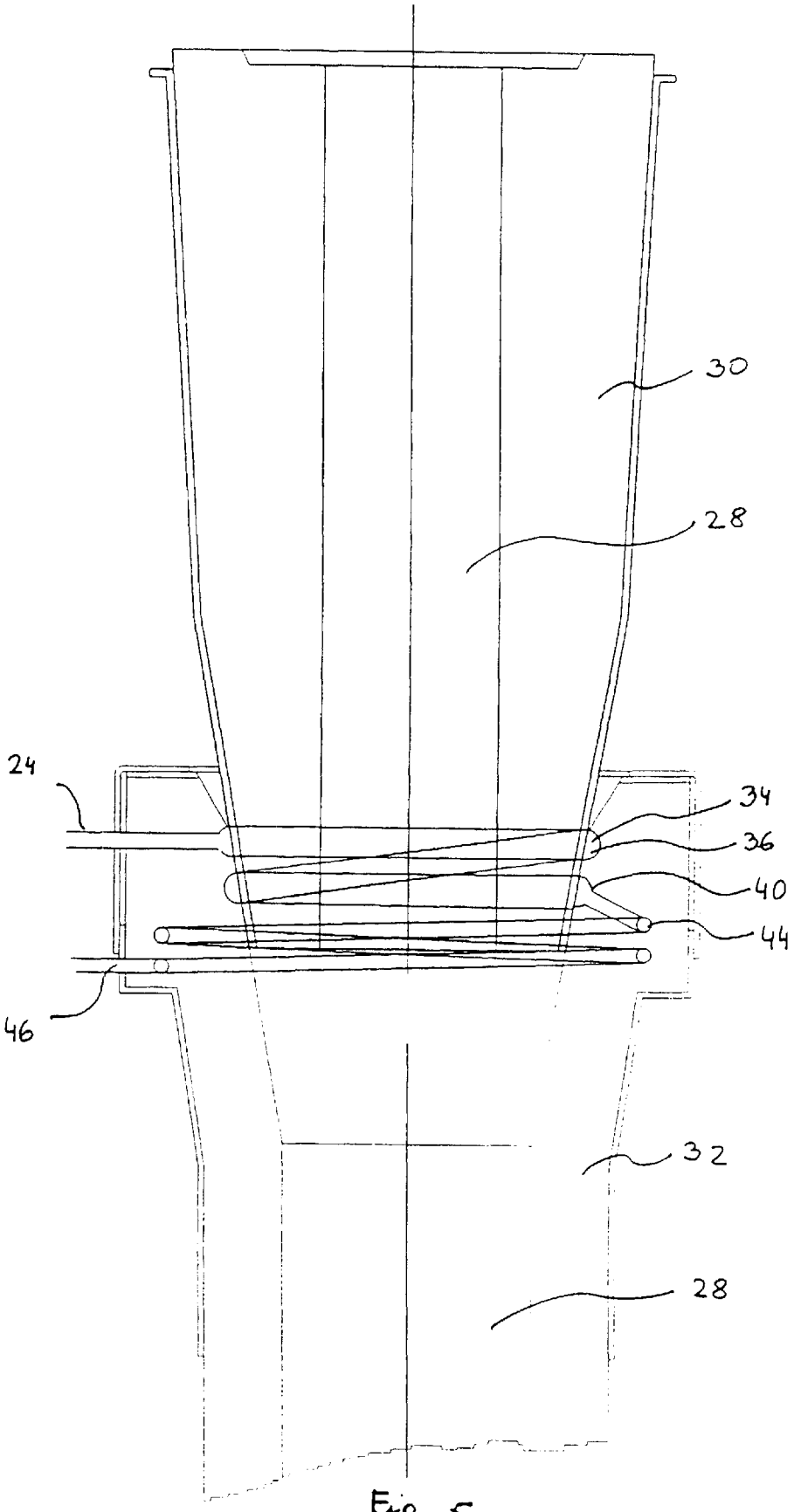
FIG. 5 is a view similar to that in FIG. 3, in which the shroud channel runs through the mating surface between refractory assemblies in several helical turns and has, before the venting outlet, a narrow crosssection constituting a calibrated head loss.
Figure 6:
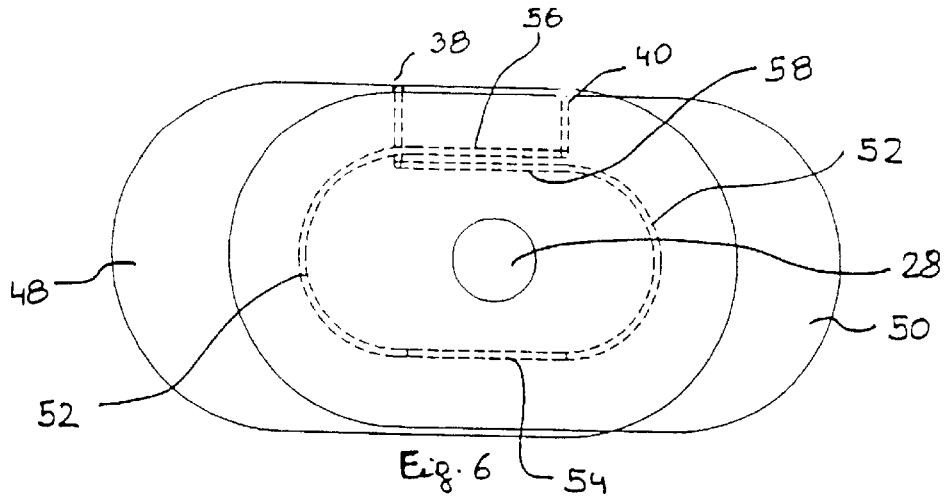
FIGS. 6 and 7 are views from above and from the front of two plates of a slide gate valve of a plant for transferring liquid metal according to the invention, the slide gate valve being in the completely open position.
Figure 7:
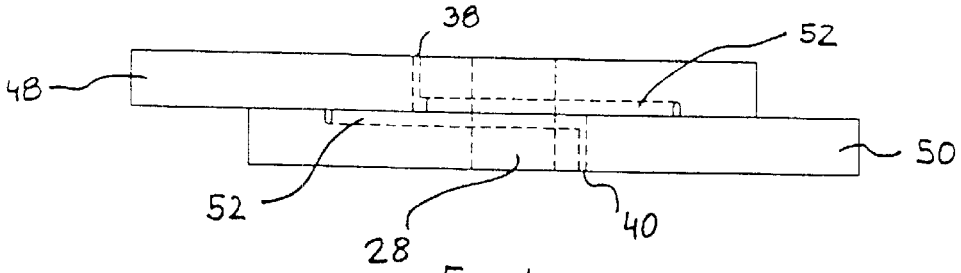
Figure 8:
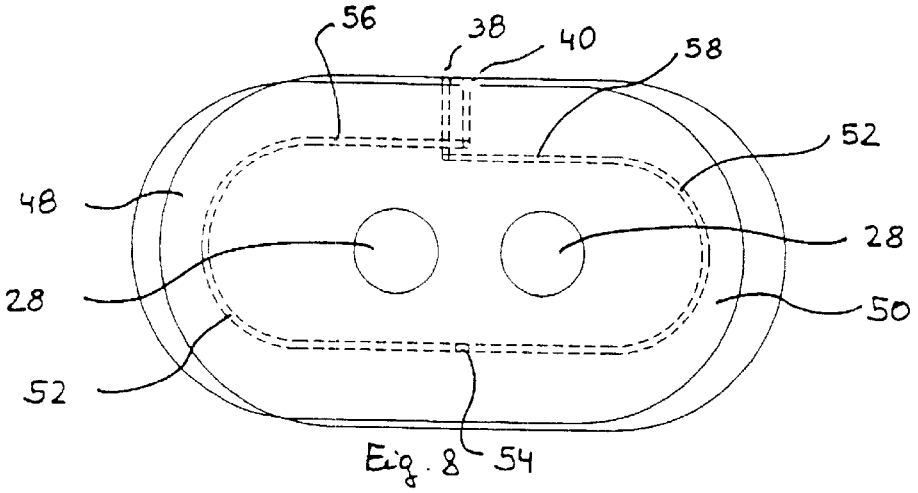
FIGS. 8 and 9 are views from above and from the front of these same two plates, the slide gate valve being in the completely closed position.
Figure 9:
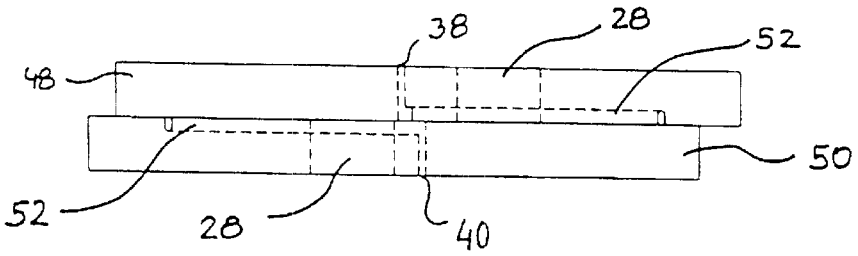

In a variant of the invention, in which the linear shroud channel 34 is connected to a calibrated head loss 44 which may consist of a simple pipe connected to the outlet of a refractory assembly. Advantageously, it may be constituted within the actual last refractory assembly through which the shroud channel 34 runs, by means of a duct of small cross-section and of suitable length. FIG. 5 shows such an approach. The shroud channel 34 consists of a linear groove 36 running through the mating surface 22, possibly in several helical turns. The inert gas, before reaching the venting outlet 46, runs through a portion 44 of duct of small cross-section, constituting a head loss. By choosing the dimensions of this portion 44, it is possible to fix its value of the head loss. This embodiment of the invention makes it possible for the plant to avoid having an external outlet pipe, and is therefore particularly simple.

The examples illustrated in FIGS. 3 to 5 have shown plants in which the shroud channel 34 runs through one and only one refractory assembly. It is possible, without departing from the scope of the invention, to producea shroud channel 34 running through several successive refractory assemblies 42, thus ensuring that several mating surfaces 22 are shrouded by the same shroud channel 34, possibly in an order other than the order of the refractory assemblies in the tapping spout. Thus, it is possible, for example, to make the inlet 38 in a refractory assembly 42 and produce a shroud channel 34 running through several mating surfaces of the plant and going down through the refractory assemblies, without leaving the last refractory assembly.

FIGS. 6, 7, 8 and 9 show an embodiment example of a set ofrefractory assemblies according to the invention, comprising an upper plate 48 drilled with a hole forming a tapping spout 28, a lower plate 50 also having a hole, these plates being capableof sliding horizontally with respect to each other, and thus enabling the flow of liquid metal to be regulated by varying the opening of the tapping spout 28. The two plates 48, 50 each have a U-shaped groove 52. Unlike the grooves known in the prior art, for example from French Patent Application FR 74/14636, the two superposed U's overlap only by one of their arms, over a portion of their length which can vary depending on the relative position of the two plates 48 and 50. The arms 56 and 58 do not leftoverlap and are connected, at their respective ends, to the outlet 40 and to the inlet 38 of the shroud channel 34. In this plant, there is therefore a continuous linear shroud channel 34 having an inlet 38 at one end and an outlet 40 at the other, placed around the tapping spout 28. This arrangement thus makes it possible to adopt a method of regulating the injection of inert gas according to the invention by adapting a calibrated head loss either within the lower plate 50, or connected to the outside of the latter.

The distance between the arms of the U of the upper plate 48 is different from the distance between the arms ofthe U of the lower plate 50. At least one of these U's is therefore unsymmetrical with respect to the hole forming the tapping spout 28.

This embodiment is particularly suited to the system known as a nozzle with a slide gate valve.

Figure 10:
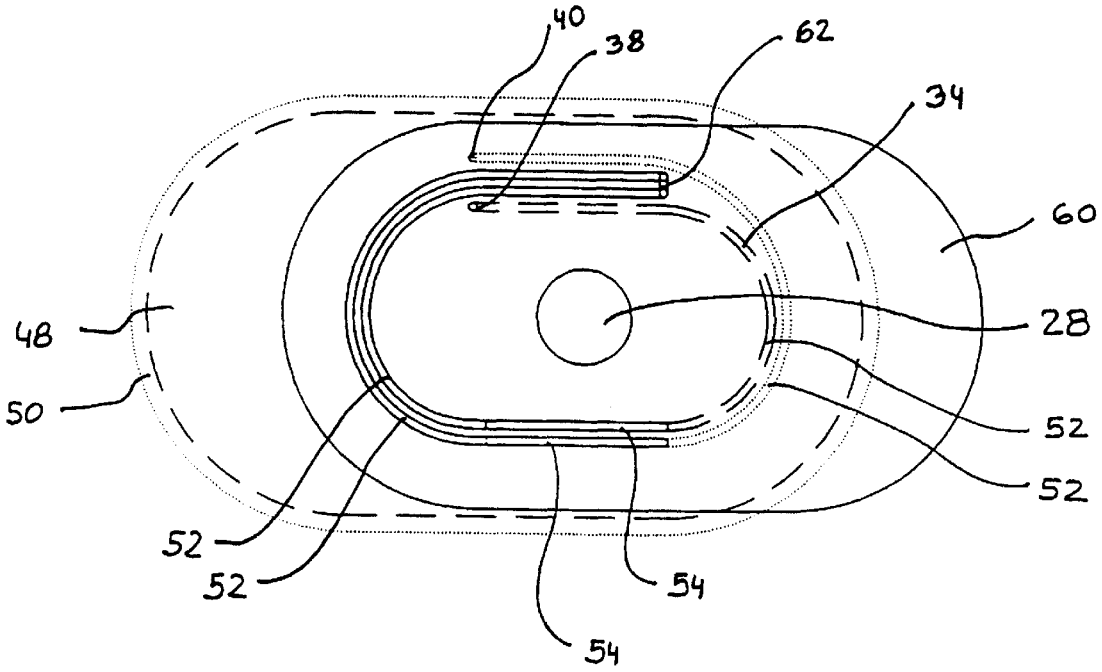
FIGS. 10 and 11 are views from above and from the front of three plates of a slide gate valve of a plant for transferring liquid metal according to the invention.
Figure 11:
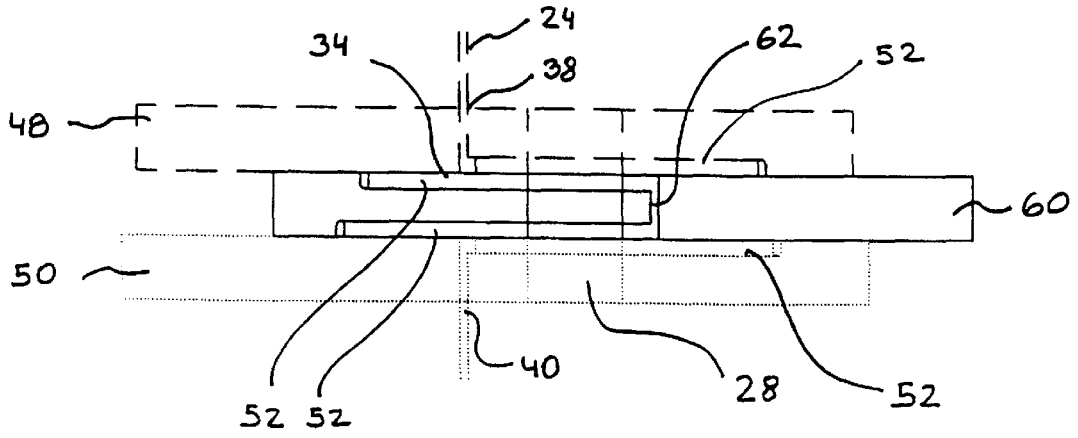

FIGS. 10 and 11 show an embodiment example of a device according to the invention which is a slide gate valve having three plates, consisting of an upper plate 48, an intermediate plate 60 which can slide horizontally, and a lower plate 50. In these figures, the upper plate 48 is depicted by the broken line, the intermediate plate 60 by the solid line and the lower plate 50 by the dotted line. The usual drawing conventions with regard to visible and concealed lines have therefore not been respected. The upper plate 48 includes the connection to the inert-gas supply pipe 24. The arrangement of the shroud channel 34 at the mating surface 22 between the upper plate 48 and the intermediate plate 60 is in every way similar to that described in the example with respect to FIGS. 6, 7, 8 and 9. The same applies to the shroud channel at the mating surface between the intermediate plate 60 and the lower plate 50. A hole 62 connects the U-shaped portion of the upper face of the intermediate plate 60 to the U-shaped portion of the lower face of this same plate. The lower plate 50 includes a connection to the outlet 40 of the shroud channel 34.

In this way, a shroud channel 34 is produced which ensures continuous flow of the inert gas from the inlet 38 to the outlet 40 of this channel, whatever the position of the intermediate plate 60.

Figure 12:
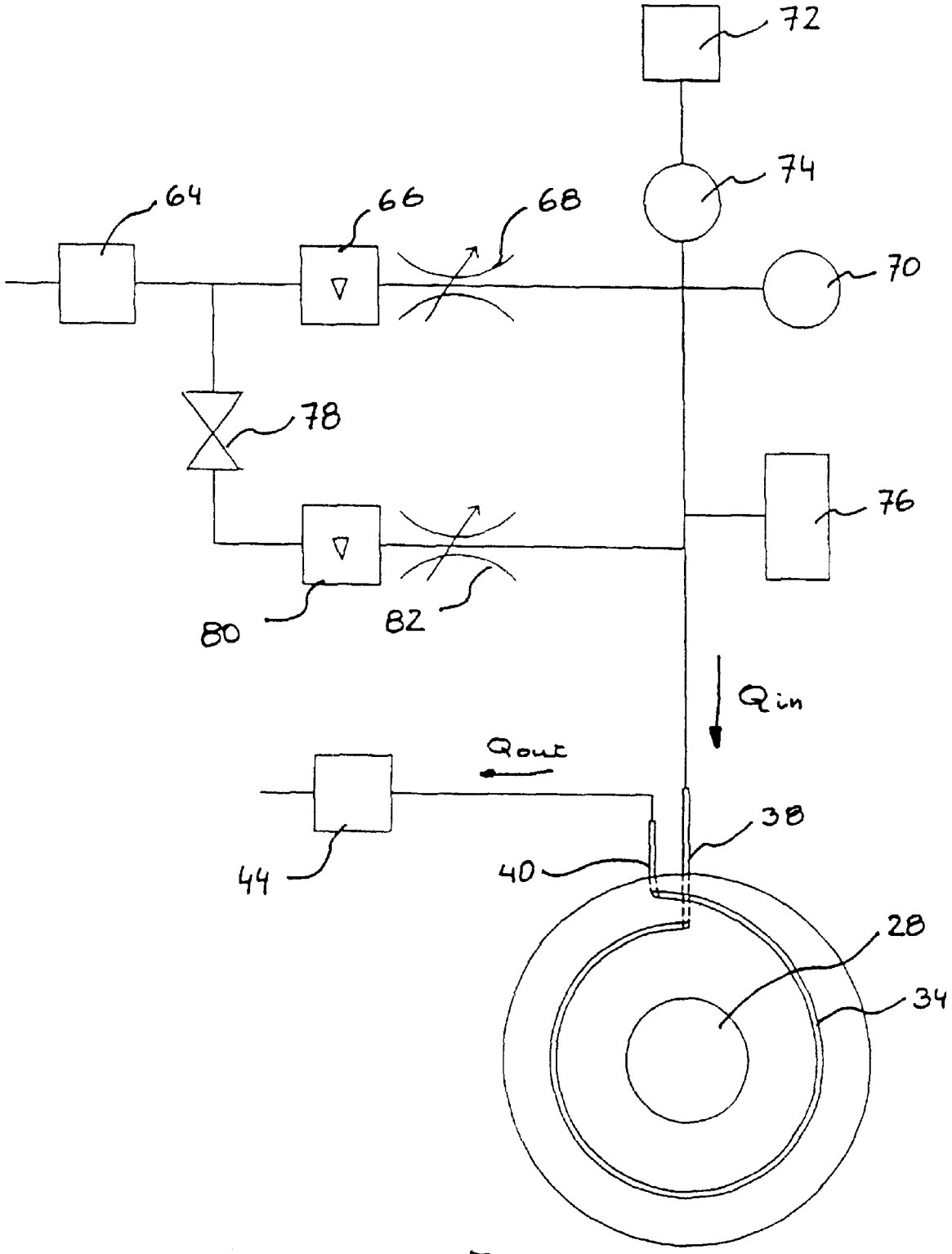
FIG. 12 is a diagrammatic representation of a plant according to the invention and of its auxiliary circuits, including means for injecting inert gas and a sealing agent.

The various methods of using a plant according to the invention will now be described in more detail and illustrated in FIG. 12.

In a first method, the inlet 38 of the shroud channel 34 is fed with inert gas and its outlet 40 is open to the air. The inert-gas feed consists of a supply, which may for example be a cylinder, a pressure-reducing valve 64, a flow meter 66 and a flow regulator 68. The setting is such as to deliver into the shroud channel 34 a constant flow of inert gas at a rate greater than the maximum possible leakage rate so that there is always an excess of inert gas escaping via the outlet 40.Thus, while still being certain that only inert gas can be drawn into the tapping spout 28, the quantity of inert gas drawn into the tapping spout 28 is reduced to the minimum compatible with the state of the mating surface 22 since the pressure in the shroud channel is reduced to the minimum possible, i.e., atmospheric pressure. This method offers the advantage of very great simplicity in the management and an optimum efficiency.

An improvement in the method consists in adding a second flow meter to the outlet 40 of the shroud channel 34 so as to measure the excess inert gas escaping via the outlet 40. Thus, it is possible to know the flow rate of inert gas actually drawn into the tapping spout 28 by difference with the flow rate $Q_{in}$ of inert gas introduced into the shroud channel 34. The flow meter is advantageously produced by means of a calibrated head loss 44 and a pressure gauge 70. The flow rate $Q_{out}$ of inert gas passing through the calibrated head loss 44 generates a slight overpressure $P_{in}$ in the shroud channel 34 which is read by a pressure gauge 70. The relationship between the pressure $P_{in}$ measured by the pressure gauge 70 and the flowrate $Q_{out}$ of inertgasescaping via the outlet 40 is provided by known empirical relationships of the form:

$$Q_{out-K} \cdot f(P_{in})$$

whereK is a calibration coefficient of the calibrated head loss.

Since the head loss of the shroud channel 34is low, the pressure $P_{in}$ measured by the pressure gauge 70 at the inlet of the shroud channel 34 is approximately equal to the pressure that would be measured at the outlet 40 of this channel. Placing the pressure gauge 70 at the inlet 38 of the shroud channel makes it possible to avoid the difficulties in connecting the latter to the outlet. These difficulties comprise difficulties with regard to the environment in the vicinity of the tapping spout 28 and, if the calibrated head loss 44 is made within a refractory assembly, with regard to accessibility.

By producing the calibrated head loss in the form of a tube having a diameter of from 3 to 4 mm and a length of from 1 to 4 m, a low overpressure (from 0.1 to 0.3 bar) is generated, this being barely prejudicial to the leakage rate. This embodiment offers the advantage of being able to measure the excess flow escaping via the outlet of the shroud channel 34 remotely. Another advantage of this method is that this form of flow meter is extremely simple and robust and can be installed directly at the outlet of the refractory, despite the difficulties specific to the difficult environment. It is therefore not necessary to fit an additional pipe for installing the flow meter in a protected and operator-accessible place.

As described up to now, the method makes it possible to guarantee that the tapping spout is protected from any induction of air, without appreciably increasing the induction of inert gas. The performance limit depends only on the state of the mating surface.

A significant improvement in the invention consists in introducing a sealing agent into the shroud channel 34. This sealing agent is stored in a reservoir 72 and introduced as required into the inert-gas pipe by means of the injector 74.

Introduction of the sealing agent may be continuous, since excess sealing agent is automatically entrained to the outside via the outlet 40 with the excess inert gas. There is no risk of blocking the gas pipe 24 or the shroud channel 34 by accumulation of the sealing agent. Another advantage of the method is that, since the circuit has no dead zone, the inert gas flows along the entire length of the shroud channel 34 with a speed sufficient to ensure that the sealing agent is transported into every place where it may be necessary. The method of continuous introduction is preferred when the quality of the mating surface may be adversely, affected at any moment. This is particularly the case with mating surfaces between plates of a slide gate valve for regulating the tapping jet, which undergo frequent movement and therefore run the risk of creating new leaks at any moment. This is also the case for mating surfaces 22 between a collecting nozzle of a ladle slide gate valve and a jet shroud tube. The movements of the slide gate valve and the vibrations of the tube which are induced by the flowof the liquid metal may at any moment cause a deterioration in the quality of the mating surface.

Another application of the invention, described below, will preferably be applied in the case of mating surfaces which are for the most part static during tapping but which may be altered periodically. This is in particular the case for tube changers as described in U.S. Pat. No. 4,569,528. In such a tube changer, the tube at its upper part has a plate which is pressed firmly against a stationary plate of the upstream container. When the tube is worn, it is replaced by a fresh tube, generally by sliding a new tube against the stationary upper plate. The mating surface is generally greatly impaired by the operation of changing a tube, whereas it is only rarely impaired during the lifetime of the tube, the mating surface then being static. For such an application, a preferred variant of the method according to the invention consists in initiating the introduction of the sealing agent only when the state of quality of the mating surface requires it. When the leakage rate rises above a predetermined acceptable value, i.e., when the pressure read by the pressure gauge 70 drops below a predetermined threshold, introduction of the sealing agent is triggered. As soon as the leakage rate has been reduced to a predetermined value, that is to say that the pressure at the pressure gauge 70 has risen above a threshold, introduction of the sealing agent is stopped.

This method can be easily automated by adding a double-threshold pressure detector 76.

Another improvement of the method according to the invention consists in introducing an additional inert-gas feed line consisting of a valve 78, optionally controlled, a flow meter 80 and a flow regulator 82. The valve 78 is opened simultaneously with the triggering of the introduction of sealing agent so as to deliver an additional flow of inert gas during the introduction.

This method offers the advantage of being able to set the main flow rate of inert gas delivered by the regulator 68 at a relatively low level, for example 10 N 1/min, which is sufficient during the normal operation of casting when the mating surface is sealed correctly, and of using a sufficiently high flow rate when the mating surface has deteriorated, for example after changing a tube, in order to maintain an excess of inert gas, to guarantee effective transport of the sealing agent and to remove the excess via the outlet 40.

The embodiments described above with reference to the drawings are non-limiting examples of refractory assemblies, plants and methods of the invention. In particular, a shroud channel running through any number of mating surfaces 22 between refractory assemblies, whether stationary or movable, forms part of the invention.

I claim:

1. A set of refractory assemblies for transferring liquid metal between an upstream container and a downstream container, the set comprising:

(a) a plurality of refractory assemblies, comprising a first refractory assembly having a mating surface for mating with a corresponding mating surface of an adjacent second refractory assembly that is capable of movement relative to the first refractory assembly;

(b) a tapping spout formed by the refractory assemblies through which the metal flows from the upstream container into the downstream container;

(c) a flow regulator for regulating the flow of liquid metal through the tapping spout; and (d) a shroud channel circumscribing the tapping spout and opened to the mating surface between the first and second refractory assemblies, and the shroud channel having an inlet capable of allowing the intake of a fluid and an outlet capable of allowing the fluid to escape from the refractory assemblies.

2. The set of refractory assemblies according to claim 1, wherein the shroud channel is continuous.

3. The set of refractory assemblies according to claim 2, wherein the shroud channel passes through at least two mating surfaces and the continuity of the shroud channel is maintained by corresponding channels in the mating surfaces.

4. The set of refractory assemblies according to claim 1, wherein the inlet is on the first assembly and the outlet is on the second assembly.

5. The set of refractory assemblies according to claim 1, wherein the inlet and the outlet are on a single refractory assembly.

6. The set of refractory assemblies according to claim 1, wherein the flow regulator comprises a calibrated head loss terminated by a venting outlet connected to the outlet.

7. The set of refractory assemblies according to claim 6, wherein the calibrated head loss consists of a duct having a small cross-sectional area and a suitable length.

8. The set of refractory assemblies according to claim 1, wherein at least two refractory assemblies are adjacent plates that constitute a movable slide gate valve, the assemblies comprising:

(a) a first plate having on a first mating surface a first U-shaped shroud channel with arms, the arms of the first shroud channel aligned with movement of the valve; and (b) a second plate having on a second mating surface mating with the first mating surface, the second mating surface having a second U-shaped shroud channel with arms, the arms of the second U-shape aligned with movement of the valve, a first arm of the first plate superimposed on a first arm of the second plate, thereby ensuring continuity of the shroud channel, the second arm of the first plate and the second arm of the second plate being offset so that no superposition occurs.

9. The refractory assembly of claim 8, wherein at least one U-shaped shroud channel is placed non-symmetrically around the tapping spout.

10. A method of regulating a supply of inert gas in a set of refractory assemblies that define a tapping spout where the set of refractory assemblies contact at a mating surface and are capable of relative movement, and a shroud channel circumscribing the tapping spout and opened to the mating surface, the method permits liquid metal to flow between an upstream container and a downstream container, the method comprising injecting inert gas into an inlet of the shroud channel in the set at a rate sufficient to permit excess gas to escape from an outlet of the shroud channel despite gas being drawn into the tapping spout.

11. The method of claim 10 further comprising:

(a) determining a flow rate of the inert gas at the outlet; and (b) adjusting a flow rate of the inert gas at the inlet to maintain a predetermined positive pressure in the shroud channel.

12. The method of claim 10 further comprising injecting a sealing agent into the inlet when a flow rate of inert gas drawn into the tapping spout exceeds a permitted limit, the flow rate into the tapping spout determined as the difference between the flow rate at the inlet and the flow rate at the outlet.

13. The set of refractory assemblies according to claim 1, wherein the flow regulator comprises an inlet flow meter at the inlet of the shroud channel and an outlet flow meter at the outlet of the shroud channel.

14. The set of refractory assemblies according to claim 1, wherein the set includes a regulator for maintaining a positive flow rate of inert gas escaping from the outlet.

15. A set of refractory assemblies for transferring liquid metal between an upstream container and a downstream container, the set comprising:

(a) a first refractory assembly having a first mating surface and an inner surface defining a first casting channel;

(b) a second refractory assembly capable of movement relative to the first assembly, and having a second mating surface adapted to mate with the first mating surface and an inner surface defining a second casting channel, at least partial alignment of the first and second casting channels forming a tapping spout through which metal can flow from the upstream container into the downstream container; and (c) a shroud channel circumscribing the tapping spout and opened to the mating surfaces of the refractory assemblies, and the shroud channel having an inlet capable of allowing the intake of a fluid and an outlet capable of allowing the fluid to escape from the refractory assemblies.

16. The set of refractory assemblies of claim 15, wherein the shroud channel comprises a U-shaped section which is placed non-symmetrically around the tapping spout.

17. The set of refractory assemblies of claim 1, wherein the plurality of refractory assemblies are selected from the group consisting of collecting nozzles, shroud tubes, plates and combinations thereof.

* * * * *